United States Patent [19]

Hirooka et al.

[11] Patent Number: 4,542,633

[45] Date of Patent: Sep. 24, 1985

[54] AGITATING TYPE WASHING MACHINE

[75] Inventors: Hiroshi Hirooka, Tokyo; Yoshio Yoshida, Ayase; Toshio Fukushi, Hiratsuka; Yasuo Takeya, Yokohama, all of Japan

[73] Assignees: Mitsubishi Denki Kabushiki Kaisha; Nihon Kentetsu Co., Ltd., both of Tokyo, Japan

[21] Appl. No.: 581,154

[22] Filed: Feb. 17, 1984

[30] Foreign Application Priority Data

Feb. 21, 1983 [JP] Japan ..... 58-27461

[51] Int. Cl.[4] ..... D06F 17/08; D06F 33/02

[52] U.S. Cl. ..... 68/12 R; 68/133; 318/282

[58] Field of Search ..... 68/12 R, 131, 133; 318/280, 281, 282, 286

[56] References Cited

U.S. PATENT DOCUMENTS 3,369,381 2/1968 Crane et al. ..... 68/12 R 4,335,592 6/1982 Torita ..... 68/12 R

FOREIGN PATENT DOCUMENTS 137865 10/1979 Japan ..... 68/12 R

*Primary Examiner*—Philip R. Coe

*Attorney, Agent, or Firm*—Armstrong, Nikaido, Marmelstein & Kubovcik

[57] ABSTRACT

In an agitating type washing machine a washing drive motor is run reciprocally in opposite directions to rotate an agitating wheel within a washing tank alternately in one and the other directions to perform intended washing, the washing machine comprises a rotational angle detector for detecting an angle of rotation of the agitating wheel, and a control for controlling the motor in response to a detection signal from the rotational angle detector. The control interrupts energization of the motor when the angle of actual rotation of said agitating wheel or the number of rotations of the motor reaches a predetermined value, the control means controlling the motor to run in a reverse direction when rotation of the agitating wheel by inertia in one direction is almost stopped.

12 Claims, 11 Drawing Figures

AGITATING TYPE WASHING MACHINE

BACKGROUND OF THE INVENTION

This invention relates to an agitating type washing machine in which an agitating wheel is driven to operate reciprocally in opposite directions by a drive motor.

In an agitating type washing machine, an agitating wheel disposed in the center on a bottom of the machine is reciprocally rotated within a predetermined angle to effect intended washing operations, as widely known in the art. Conventionally, in order to effect such a reciprocal motion, such an agitating type washing machine includes a gearing, a link mechanism, and so on, by way of which rotation of a motor is transmitted to an agitating wheel. Thus, an agitating type washing machine is applicable particularly to a large volume washing machine. However, since a mechanism for producing a reciprocal motion therein is complicated and is thus expensive in cost, it is difficult to employ such a mechanism for a small washing machine.

In recent years, in order to introduce an agitating type into a small washing machine, an agitating type washing machine has been proposed in which a motor is directly controlled to run in opposite directions using a timer and so on to reciprocally rotate an agitating wheel. This system only necessitates control of duration of energization of a motor and thus can be produced advantageously at a low cost. However, it is disadvantageous in that reciprocal angular rotations of an agitating wheel will not be held constant depending upon variations in an amount of the washing, a voltage of a power supply, and so on, thus preventing sufficient performance of functions inherent to the agitating type.

In particular, since this system is a timing controlling system which utilizes a timer, an interval of time from interruption of energization of a motor to actual stopping thereof is long when the machine is run either without a load, that is, without any washing, or with a little washing. On the other hand, when the machine has a large amount of washing to wash, such washing acts to brake the motor and hence the motor is stopped in a reduced interval of time. Accordingly, if an interval of time required to stop a motor of the machine is determined for no load running of the machine which provides a maximum interval of time for stopping, then when there is a large amount of washing, some wasteful time will appear before the machine is run in the opposite direction after deenergization of the motor, resulting in deterioration in efficiency of washing. Further, since durations of energization of a motor are held constant, angular rotation of an agitating wheel will be large when there is a little washing, but on the other hand, when the machine has a large amount of washing, angular rotation of the agitating wheel will be small. Thus, the system is disadvantageous in that it presents characteristics which are reverse to those required for such a washing machine. Accordingly, if it is intended, in such conditions, to wash a given amount of washing, then when there is no water in a washing tank, that is, upon no load running of the machine, the agitating wheel may rotate in several rotations and thus there may possibly be a danger of a hand of a man or the like being caught by the agitating wheel. A system has also been proposed in which a plurality of water flows are determined in prior in accordance of amounts of washing and one of such water flows may be selected by means of a push button switch or the like each time the machine is used, in order to prevent damage to a cloth of washing. But, in this system, the amount of washing must be measured accurately each time the machine is used. However, such measurement is troublesome, is actually effected with the eye, and results in insufficient attainment of performance of the washing machine. Besides, it is also disadvantageous in that, if an operator inadvertently forgot to selectively set a water flow, the clothing might be damaged.

A further system has also been proposed in which a number of controlled time intervals are provided in accordance with amounts of washing and are changed over to wash a given amount of washing. But, this system is also disadvantageous in that it is accompanied by a complicated control.

SUMMARY OF THE INVENTION

The present invention has thus been made in consideration of the circumstances as described above, and it is an object of the invention to provide an agitating type washing machine which minimizes variations in angles of rotation of an agitating wheel due to varying amounts of washing and which can eliminate a loss of time which may appear upon changing over of running of the machine from one to the other direction or vice versa when the machine has a large amount of articles to wash.

DETAILED DESCRIPTION OF THE EMBODIMENTS

Figure 1:
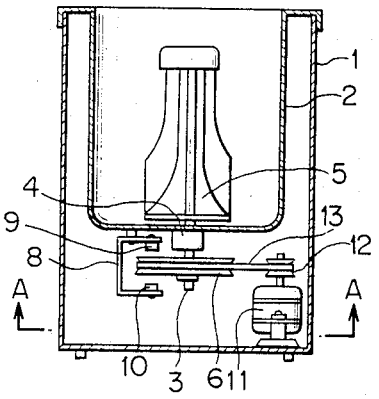
FIG. 1 is a sectional view showing an embodiment of an agitating type washing machine of the present invention.
Figure 2:
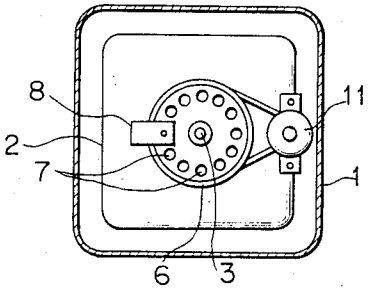
FIG. 2 is a sectional view taken along the line A—A of the FIG. 1.

An embodiment of the present invention will now be described with reference to the accompanying drawings. Referring to FIGS. 1 and 2, a washing tank 2 is secured within the outer housing 1 of the tank and articles are washed in the washing tank 2. A main shaft 3 is mounted water-tight at the center of a bottom of the washing tank 2 and is supported for rotation by means of a main shaft bearing 4. An agitating wheel 5 is mounted on the main shaft 3 within the washing tank 2, and a pulley 6 is mounted at a bottom end of the main shaft 3 and has a plurality of detection holes 7 for detection of a rotational angle of the agitating wheel 5 perforated in a predetermined spaced relationship along a circular line therein (FIG. 2). A rotational angle detector 8 includes a light emitting section 9 and a light receiving section 10 which receives, at a position of a detection hole 7 of the pulley 6, a beam of light projected from the light emitting section 9 and produces a number of pulse signals corresponding to an angle of rotation of the pulley 6 and hence an angle of rotation of the agitating wheel 5. A washing machine drive motor 11 is mounted on the bottom in the outer housing 1. Another pulley 12 is mounted on the motor 11, and a belt 13 interconnects the pulleys 6 and 12. Rotation of the motor 11 is thus transmitted to the agitating wheel 5 by way of the pulleys 6 and 12 and the belt 13.

Figure 3:
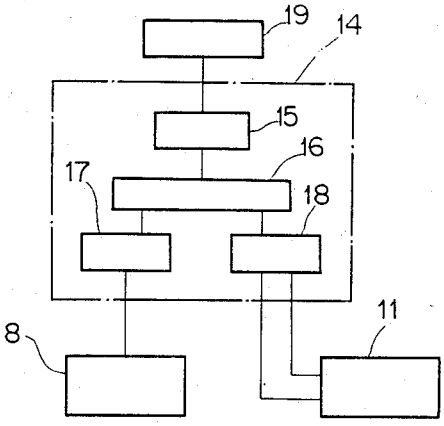
FIG. 3 is a schematic diagram showing a control system for the arrangement of FIG. 1.

FIG. 3 shows a control system for the arrangement of FIG. 1, control circuit 14 includes a memory 15, an operating processing device 16, an input control 17 and an output control 18. A power source is connected to the control circuit 14 by way of a switch 19. Detection signals representative of an angle of rotation of the agitating wheel 5 detected by the rotational angle detector 8 are inputted to the control circuit 14 through the input conrol 17 and are operated and processed by the memory 15 and the operating processing device 16. A signal produced as a result of such processing is applied as a control signal to the motor 11 through the output control 18 so as to rotate the motor 11 in a clockwise or counterclockwise direction in accordance with the output signal.

Figure 4:
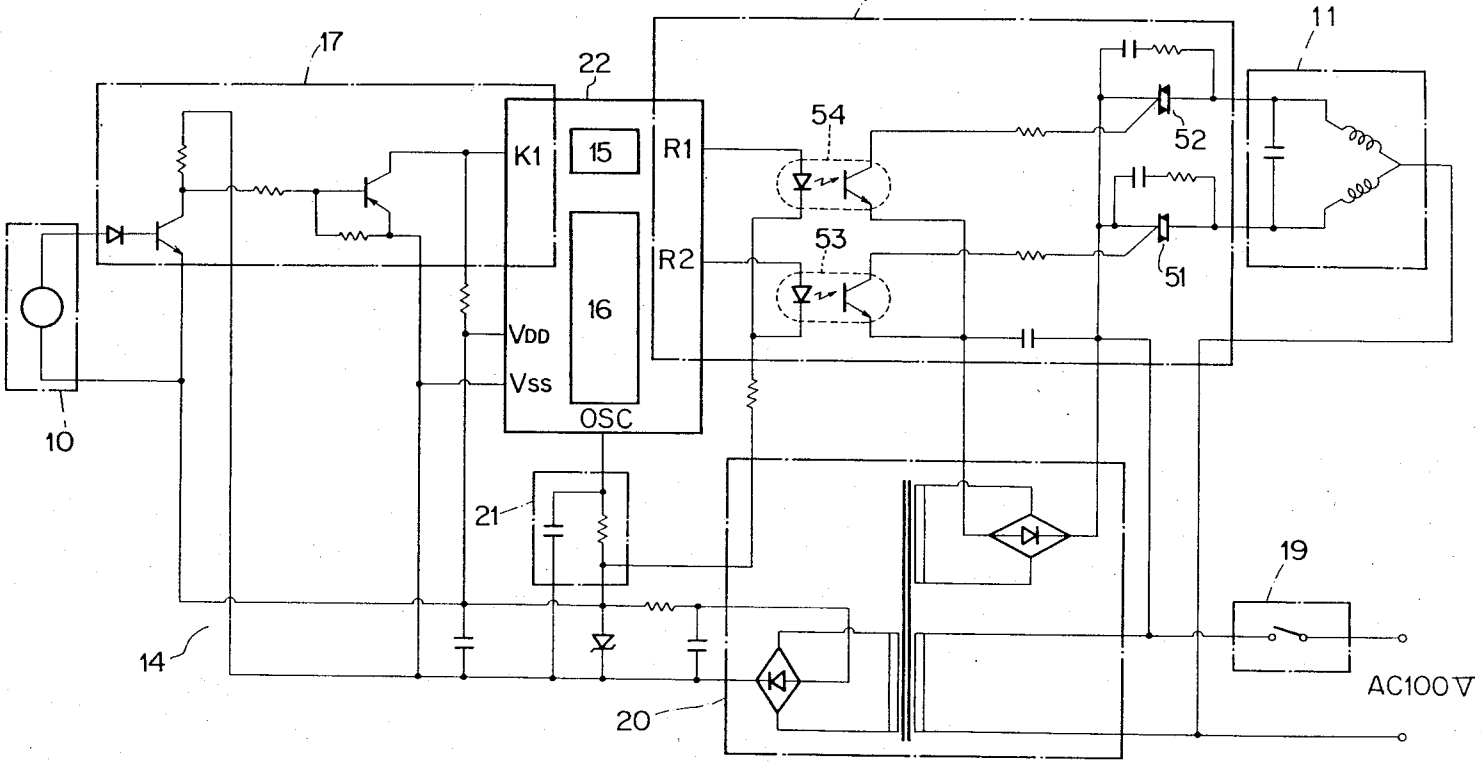
FIG. 4 is a circuit diagram showing the details of the control system of FIG. 3.

FIG. 4 shows the details of the circuit of FIG. 3. The reference numeral 19 designates a power switch; 20 a d.c. power for a gate power of thyristors 51 and 52 which turn on or off the clockwise and counterclockwise rotation of the motor 11 respectively and a drive power for a microcomputer 22 having a memory 15 and an operation processor 16 within the control circuit 14; 21 a clock generator which produces reference clock time for the microcomputer 22; 17 an input controller. The input controller converts the sinusoidal electric output which is generated from the rotation detector 10 in synchronization with the rotation into pulse like electric output and then applied it to an input port $K_1$ of the microcomputer. Reference numeral 18 designates an output controller including photocouplers 53 and 54 and the thyristors 51 and 52 which control the turn-on or turn-off of the clockwise and counterclockwise rotation of the motor 11 in response to signals from output ports $R_1$ and $R_2$ of the microcomputer.

Figure 5:
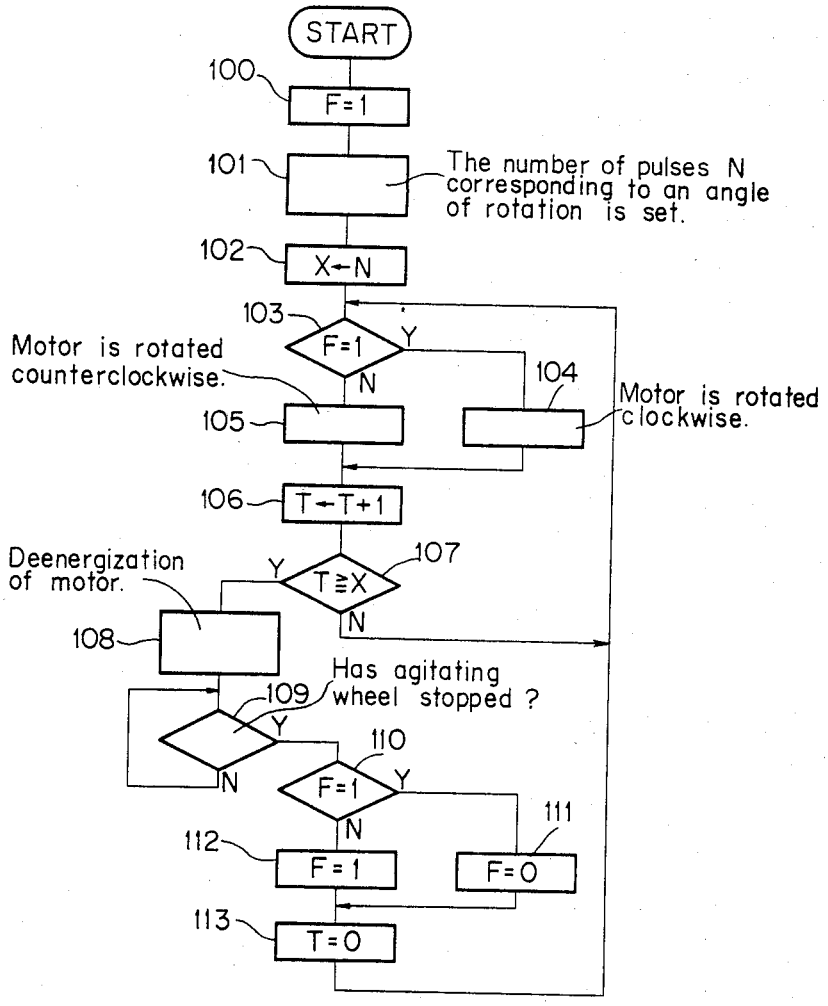
FIG. 5 is a flow chart showing the operation of the arrangement of FIG. 1 and particularly of the control system of FIG. 3.

FIG. 5 is a flow chart which indicates operations of the arrangement and particularly of the control system thereof as described above. Step 100 is a rotational direction flag setting step at which a flag is set which represents a running direction of the motor 11, and next step 101 is a rotational angle setting step for setting an angle of rotation of the agitating wheel 5 (an angle over which the motor is energized). Thus, at step 101, the number of pulses N corresponding to an angle of rotation is set, and this value is stored in a register X at next step 102. Subsequent step 103 is a rotational direction discriminating step for determining the rotational direction of the motor 11. Step 106 is a counter step for counting an angle of rotation of the agitating wheel 5 (the number of pulses from the rotational angle detector 8), and the count is inputted to a register T. Step 107 is a comparing step at which the angle of rotation of the agitating wheel 5 is compared with the preset value N in order to determine if the former reaches the latter. Step 109 is a stopping discriminating step at which it is determined that pulse signals from the rotational angle detector 8 are terminated and hence the agitating wheel 5 is stopped, and step 110 is a rotational direction setting step at which a direction of rotation of the motor is set.

Operations of the arrangement as described above will now be described. At first, washing or articles to be washed, water and a cleanser are put into the washing tank 2, and the power switch 19 is switched on. At step 100, the flag F is set to 1 so as to provide for rotation of the motor in a clockwise direction, and at next step 101, the pulse number N representative of an angle over which the agitating wheel 5 is to be rotated is set and the value is put into the register X at subsequent step 102. Since $F=1$ at the rotation direction discriminating step 103, controls advances to step 104 so that the motor 11 is rotated in the clockwise direction thereby to rotate the agitating wheel 5 in the clockwise direction through the pulley 6 to thus begin washing operations. At the same time, pulse signals are produced from the rotational angle detector 8. The pulse signals are counted at counter step 106 and are placed into the T register, and at next step 107, the contents of the register T and the register X are compared with each other, and if $T<X$, control goes back to step 103 to continue clockwise rotation of the motor 11. On the other hand, if $T>X$, then the motor 11 is deenergized at step 108. At next step 109, it is detected that there is no pulse signal received from the rotational angle detector 8, thereby confirming stopping of the agitating wheel 5 which has continued its rotation due to an inertia force thereof. Then, since $F=1$ at step 110, the control advances to step 111 at which the flag F is set $F=0$ and then returns to step 103. Since $F=0$ now, control advances to step 105 at which the motor 11 initiates its rotation in the counterclockwise direction. The program will now proceed in a similar manner as for the clockwise rotation of the motor 11. In this way, the agitating wheel 5 will repeat its reciprocal rotational movement to continue washing operations until the power switch 19, FIG. 4 is switched off.

Now, description will be given of another example of detecting means which can be applied to the present invention.

Figure 6:
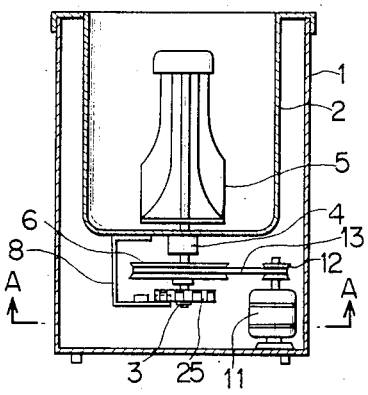
FIG. 6 is a sectional view showing another embodiment of the washing machine.
Figure 7:
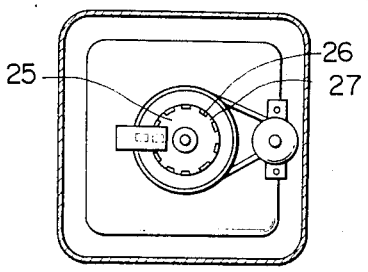
FIG. 7 is a sectional view taken along the line A—A of FIG. 6.
Figure 8:
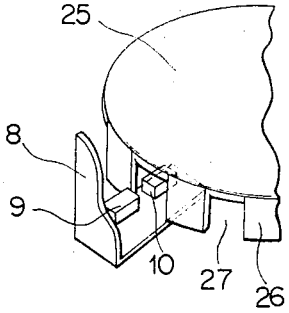
FIG. 8 is an enlarged partially cutaway perspective view showing a rotation angle detector.

While an example is shown in FIG. 1 in which the pulley 6 has a plurality of holes 7 perforated therein for detection of an angle of rotation and is interposed between the light emitting means 9 above and the light receiving means 10 below, alternatively an independent detection disk 25 may be provided at an end portion of the main shaft 3, as shown in FIGS. 6 to 8. The side wall section 26 of the detection disk 25 has a plurality of detection recesses 27 formed in a circumferentially equally spaced relationship therein to provide a comb-like configuration to the side wall section 26. Reference numeral 8 denotes a rotational angle detector mounted on the bottom of the washing tank 2 and including a light emitting element 9 and a light receiving element 10 disposed in opposing relationship adjacent opposite sides of the side wall section 26. Thus, when a detection recess 27 is positioned between the light emitting element 9 and the light receiving element 10, light from the light emitting element 9 is received by the light receiving element 10. On the contrary, when a portion of the side wall section 26 other than the detection recesses 27 is positioned between the light emitting element 9 and the light receiving element 10, light from the light emitting element 9 is interrupted thereby. Accordingly, pulse signals which correspond to an angle of rotation of the agitating wheel 5 are outputted from the light receiving element 10.

It is to be noted that the rotational angle detector 8 of the example described just above may alternatively be constituted such that the detection disk 25 is made of a magnetic material such as, for example, iron and the light emitting element 9 and the light receiving element 10 are replaced by a Hall element and a permanent magnet, respectively. In particular, a predetermined voltage is applied to the Hall element 9, and as commonly known in the art, an electric current flowing through the Hall element 9 varies in response to the intensity of a magnetic field due to a Hall effect, and the direction of a magnetic field varies in response to the presence and absence of a recess 27 of the disk 25. As a result, as the detection disk 25 which is a magnetic member is rotated, an electric current flowing through the Hall element 9 varies each time a recess 27 passes thereby. The electric current is processed electrically such that, as the detection disk 25 is rotated to rotate the side wall 26, pulse-like electric signals corresponding to an angle of actual rotation of the agitating wheel 5 are detected.

It is to be mentioned that an angle of rotation can be detected similarly if the Hall element is otherwise replaced by a magnetic resistor element which has an electric resistance which varies in response to the intensity of a magnetic field.

Figure 9:
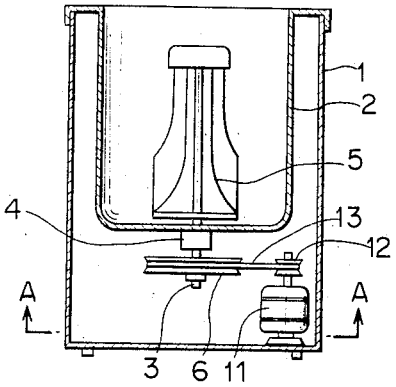
FIG. 9 is a sectional view similar to FIG. 6.
Figure 10:
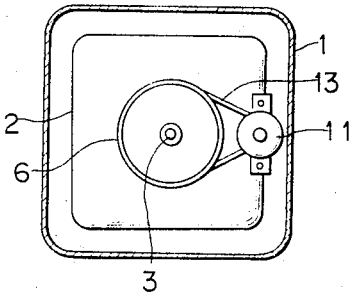
FIG. 10 is a sectional view taken along the line A—A of FIG. 9.
Figure 11:
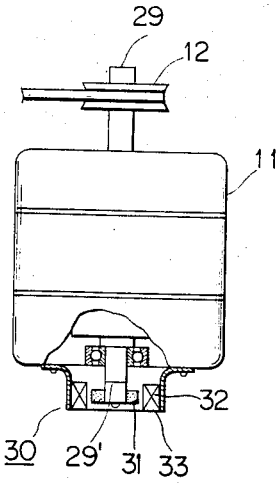
FIG. 11 is an enlarged partially cutaway view showing a rotation angle detector secured to the motor shaft.

It is also to be mentioned that, while only the examples of detecting means which involve detection of an angle of rotation of the agitating wheel 5, an angle of rotation of the agitating wheel can otherwise be detected indirectly from detection of the number of rotations of the agitating wheel. Such an example is illustrated in FIGS. 9 to 11. In this arrangement, a reduction ratio which is determined by a pulley 6 and a motor pulley 12 is almost 10:1 so that one complete rotation of a motor will rotate an agitating wheel 5 by an angle of about 36 degress.

In the arrangement of FIGS. 9 to 11, a motor 11 having high rigidity includes a rotation detector 30 disposed therefor for detecting the number of rotations of the motor. The rotation detector 30 includes a cylindrical permanent magnet 31 fixedly mounted on a lower end 29' of a motor shaft 29, a generating coil 32 wound in a cylindrical form around an outer periphery of the permanent magnet 31 with a predetermined air gap left therebetween, and a magnetic shield member 33 disposed in the air gap between the permanent magnet 31 and the generating coil 32 to partially interrupt a magnetic field of the permanent magnet 31. Since, in the rotation detector 30 having such a construction as described above, rotation of the motor shaft 29 will rotate the permanent magnet 31 fixedly mounted thereon, a sinusoidal electric current is induced in the generating coil 32 in synchronized relationship to rotation of the permanent magnet 31, as commonly known in the art. The sinusoidal electric current is processed electrically so that, as the motor 11 rotates, pulse-like electric signals are outputted in synchronism therewith. In this way, the rotation detector 30 is disposed in the motor 11 in which most parts are made of metal materials so that rotational conditions of the motor can be detected directly. This construction thus assures high accuracy in assembly and high workability and enables accurate and stabilized detection of rotational conditions of a motor.

What is claimed is:

1. An agitating type washing machine of the type in which a washing drive motor is reciprocated in opposite directions to rotate an agitating wheel within a washing tank alternately in one and the other directions to perform intended washing, comprising a rotational angle detecting means for detecting an angle of rotation of said agitating wheel, and a control means for controlling said motor in response to a detection signal from said rotational angle detecting means, said control means interrupting energization of said motor when the angle of rotation of said agitating wheel reaches a predetermined value and controlling said motor to run in a reverse direction when rotation of said agitating wheel by inertia in one direction comes to a stop.

2. An agitating type washing machine in which a washing drive motor is run reciprocally in opposite directions to rotate an agitating wheel within a washing tank alternately in one and the other directions to perform intended washing, a comprising a rotational angle detecting means for detecting an angle of rotation of said agitating wheel, and a control means for controlling said motor in response to a detection signal from said rotational angle detecting means, said control means interrupting energization of said motor when the number of rotations of said motor reaches a predetermined value and controlling said motor to run in a reverse direction when rotation of said agitating wheel by inertia in one direction comes to a stop.

3. An agitating type washing machine according to any one of claims 1 and 2, in which said rotational angle detecting means includes a pulley for transmitting a driving force of said washing drive motor to said agitating wheel, said pulley having a plurality of detection holes perforated therein in a spaced relationship from each other by a predetermined distance, and a light emitting means and a light receiving means disposed in opposing relationship with one of said detection holes positioned therebetween.

4. An agitating type washing machine according to any one of claims 1 and 2, in which said rotational angle detecting means includes a detection disk secured horizontally to a rotary shaft of said agitating wheel and having a plurality of detection holes formed in a predetermined spaced relationship in a planar portion thereof, and detecting means disposed in an opposing relationship with one of said detection holes of said detection disk interposed therebetween.

5. An agitating type washing machine according to claim 4, in which said last-mentioned detecting means includes a light emitting element and a light receiving element disposed in an opposing relationship to each other.

6. An agitating type washing machine according to any one of claims 1 and 2, in which said rotational angle detecting means includes a detection disk made of a magnetic material having a plurality of recesses formed in an equally spaced relationship along an outer circumference thereof, said detection disk being rotated in response to rotation of said agitating wheel and detecting means disposed at a position corresponding to the recessed portion of said detection disk.

7. An agitating type washing machine according to claim 6, in which said last-mentioned detecting means includes a light emitting element and a light receiving element disposed in an opposing relationship to each other.

8. An agitating type washing machine according to claim 6, in which said last-mentioned detecting means includes a magnetic resistor element and a magnet disposed in an opposing relationship to each other.

9. An agitating type washing machine according to claim 6, in which said last-mentioned means includes a Hall element and a magnet disposed in an opposing relationship to each other.

10. An agitating type washing machine according to claim 6, in which said detection disk has an outer circumferential end bent substantially perpendicularly thereto to form a side wall in which a plurality of recesses of a predetermined width are formed in an equally spaced relationship from each other.

11. An agitating type washing machine according to any one of claims 1 and 2, in which said rotational angle detecting means includes a magnet which rotates in response to rotation of said agitating wheel, and a generating coil disposed adjacent said magnet.

12. An agitating type washing machine according to claim 11, in which said magnet is integrally formed on a rotary shaft of said motor.

* * * * *

UNITED STATES PATENT AND TRADEMARK OFFICE

CERTIFICATE OF CORRECTION

PATENT NO. : 4,542,633

DATED : September 24, 1985

INVENTOR(S) : HIROSHI HIROOKA ET AL

It is certified that error appears in the above-identified patent and that said Letters Patent is hereby corrected as shown below:

On the cover page, Item [75], after "Yokohama" insert --- Satoshi Nagai, Fujisawa ---.

Signed and Sealed this

*Third* Day of *June 1986*

[SEAL]

*Attest:*

DONALD J. QUIGG

*Attesting Officer*

*Commissioner of Patents and Trademarks*